US007562635B1

(12) United States Patent
Morris

(10) Patent No.: US 7,562,635 B1
(45) Date of Patent: Jul. 21, 2009

(54) KAYAK PORTAGING DEVICE

(76) Inventor: Keith Morris, 24 Pincushion Dr., Grand Marais, MN (US) 55604

( * ) Notice: Subject to any disclaimer, the term of this patent is extended or adjusted under 35 U.S.C. 154(b) by 0 days.

(21) Appl. No.: 12/115,261

(22) Filed: May 5, 2008

(51) Int. Cl.
*B63B 35/71* (2006.01)

(52) U.S. Cl. ..... 114/347

(58) Field of Classification Search ..... 114/347, 114/363; 405/1; 224/266
See application file for complete search history.

(56) References Cited

U.S. PATENT DOCUMENTS 4,493,285 A * 1/1985 Williams ..... 114/363
4,768,459 A 9/1988 Cerkvenik
5,495,968 A 3/1996 Miller
5,622,403 A 4/1997 Gonda
6,047,656 A * 4/2000 McKinley et al. ..... 114/163

* cited by examiner

*Primary Examiner*—Ed Swinehart
(74) *Attorney, Agent, or Firm*—The Rudy Law Firm; William T. Helwig

(57) ABSTRACT

A kayak portaging device which incorporates a seat backrest into the yoke design, making the portaging yoke an integral part of the kayak. A u-shaped device, with a transverse yoke frame, and parallel pivot arms extending from the ends of the yoke frame to pivot points on the kayak hull forward of the seat. A curved backrest is incorporated within the u-shaped device. The device rotates from a backrest position behind the kayak seat for use while paddling, forward to an inverted position over the kayak's center of gravity for portaging. "L" brackets with padded ends are mounted on the backside of the yoke frame extending downwards. Bottle holders attached to the "L" brackets are accessible to a seated kayaker. When rotated to the inverted portaging position, pivot arms are held against positive stops by a magnetic catch, and "L" brackets now extend upwards providing elevated shoulder rests for portaging.

20 Claims, 6 Drawing Sheets

KAYAK PORTAGING DEVICE

BACKGROUND OF THE INVENTION

The invention relates to a kayak portaging device, and specifically to a pivoting kayak portage yoke, which can rotate from a position behind the kayak seat for storage while paddling, forward to an inverted position over the kayak's center of gravity for carrying. With the incorporation of a seat backrest into the design of the portage yoke, the device acts as a backrest for a kayaker while paddling, when it has been placed in the storage/backrest position.

Kayaks as a watercraft are not designed to be easily portaged or carried over long distances. Not only carrying the kayak, but the removal and subsequent repacking of items stored within the kayak, through small hatches makes moving and transport of the kayak a slow, difficult process.

A common manner for carrying a kayak is by means of two rope handles, one attached to the bow and the other attached to the stern. With this method, two people are required to perform the task of lifting and carrying. The kayak may remain fully loaded for short distances, but must be unloaded for longer carrying distances. This method is not available to the solo kayaker, who must rely on some other method or device for portaging a kayak, and is not considered relevant.

One method of transporting a kayak by a single individual involves lifting the kayak and resting the cockpit rim on the shoulder of the person carrying the kayak. This manner of portaging is uncomfortable over longer distances and results in an unequal distribution of weight on the carriers muscles and skeletal structure. A small soft pad is sometimes used to cushion the weight of the kayak and cockpit rim on the shoulder.

Another manner by which a kayak may be carried solo, is to incorporate a detachable yoke with pads, fastened to the cockpit rim. This attachment is accomplished by using adjustable mechanical members which engage the cockpit rim of the kayak. This carrying yoke is manually attached for carrying, but must then be removed and stored on or within the kayak after carrying. This yoke, if not removed, would interfere with cockpit access and use by the paddler. A carrying yoke of this design may be easily lost, misplaced, or simply forgotten.

Another device which may be used by a single individual to carry a kayak is a modified backpack frame and harness which allows the user to carry a canoe or kayak by use of the modified backpack. These devices are not simple to use, requiring attachment to and unattachment from the kayak for use, and the rigging of weight distributing poles or straps. Such devices are disclosed in U.S. Pat. No. 6,681,968 issued Jan. 27, 2004 to Zwagerman, U.S. Pat. No. 6,315,177 issued Nov. 13, 2001 to Weatherall, U.S. Pat. Nos. 6,095,599 and 5,547,246 issued Aug. 1, 2000 and Aug. 20, 1996, respectively, to Lambert, U.S. Pat. No. 6,019,263 issued Feb. 1, 2000 to Palmer, and U.S. Pat. No. 5,875,946 issued Mar. 2, 1999 to Knudsen.

The attachment of a wheeled device to a kayak is another means for moving a kayak. These devices work well on flat level surfaces, but become difficult, or impossible to use if the terrain becomes rocky, steep or uneven. These devices do not work well under adverse conditions. Such devices are disclosed in U.S. Pat. No. 6,446,570 issued Sep. 10, 2002 to Johnson, U.S. Pat. No. 6,416,066 issued Jul. 9, 2002 to Ciulis, U.S. Pat. No. 6,032,964 issued Mar. 2, 2000 to Capobianco, and U.S. Pat. No. 5,261,680 issued Nov. 16, 1993 to Freitus, et al.

As seen above, numerous methods and inventions have been developed which assist in the portaging of canoes and kayaks. The following patent are considered relevant to the disclosure:

U.S. Pat. No. 5,622,403 issued Apr. 22, 1997 to Gonda is a Multi-function canoe chair, which is a multi-function/positioned chair for a watercraft which can be adjusted as between sitting, kneeling, and portaging positions. The Gonda patent describes a modified embodiment which provides for a thwart to be passed through the chair for more solid anchorage to the watercraft and which provides a pivot point for seat orientation between the sitting, kneeling and carrying positions. The Gonda device is not designed for use in a kayak.

U.S. Pat. No. 4,768,459 issued Sep. 6, 1988 to Cerkvenik, et al. is a Canoe seat/carrying yoke, which is a frame assembly serving as an extra seat in a first position and as a carrying yoke in a second inverted position. The Cerkvenik patent describes a canoe seat/yoke which attaches to the gunwales of a canoe which can be inverted from a sitting position to a carrying position. To invert the Cerkvenik device from the sitting to the carrying position requires that the device be disconnected and flipped over and reattached (in its primary configuration). The Cerkvenik device is not designed for use in a kayak.

U.S. Pat. No. 5,495,968 issued Mar. 5, 1996 to Miller is a Canoe portaging thwart, which is a portaging thwart capable of axial rotation relative to a canoe. The axial rotation of the Miller patent provides for a smooth maintenance of balance while portaging. The Miller device does not have a sitting position. The Miller device is not designed for use in a kayak.

The Gonda and Cerkvenik patents both provide for attachable seat/yoke devices which are movable between a seat configuration and a yoke configuration. The Miller patent describes a rotatable portaging thwart.

All of the above listed relevant patents refer to devices which require attachment to a canoe thwart or incorporate a canoe thwart into their design. None of the above listed patents make use of a design which can be used in a kayak. All of the above listed patents refer to devices which, if modified to mount in a kayak, would interfere with a kayaker while paddling, and would require attaching only for carrying, and would require unattaching for paddling. None of the above listed patents refer to devices which remain attached as an integral part of a kayak during portaging and paddling. None of the above listed patents refer to devices which can simply rotate from a carry/portaging position to a storage/paddling position. None of the above listed patents refer to devices which act as a backrest for the paddler while the device is in the storage position. None of the above listed patents refer to devices which also provide accessible water bottle storage for the kayaker while the device is in the storage/backrest position.

What is needed then is a portaging device which will attach as an integral component to a kayak and is not unattached for storage, which can rotate between a portaging position and a storage position, which will not interfere with paddling while still attached in the storage position, which acts as a backrest for the paddler while in the storage position, which is simple and easy to use, and which provides accessible water bottle storage for the kayaker.

OBJECTS OF THE INVENTION

Accordingly, several objects and advantages of the invention are as follows:

It is an object of this invention to provide a compact, lightweight, portaging device which will attach as an integral component to a kayak and is not unattached for storage.

It is a further object of this invention to provide a simple portaging device which can rotate between a portaging position and a storage position.

It is another object of this invention to provide a portaging device which will not interfere with paddling a kayak while still attached in the storage position.

It is an object of this invention to provide a comfortable device which acts as a backrest for the paddler of a kayak while in the storage position.

It is another object of this invention to provide a portaging device which provides accessible water bottle storage for the kayaker while the device is in the storage/backrest position.

Further objects and advantages will become apparent from a consideration of the following description and drawings.

SUMMARY OF THE INVENTION

A kayak portaging device which incorporates a seat backrest into the yoke design, making the portaging yoke an integral part of the kayak. A u-shaped device, with a transverse yoke frame, and parallel pivot arms extending from the ends of the yoke frame to pivot points on the kayak hull forward of the seat. A curved backrest is incorporated within the u-shaped device. The device rotates from a backrest position behind the kayak seat for use while paddling, forward to an inverted position over the kayak's center of gravity for portaging. "L" brackets with padded ends are mounted on the backside of the yoke frame extending downwards. Bottle holders attached to the "L" brackets are accessible to a seated kayaker. When rotated to the inverted portaging position, pivot arms are held against positive stops by a magnetic catch, and "L" brackets now extend upwards providing elevated shoulder rests for portaging.

The kayak portaging device presents a quick, comfortable, safe manner for carrying a kayak over varying distances such as would be found portaging from lake to lake. By incorporating the seat backrest into the yoke design, the carrying device becomes an integral part of the kayak. With the kayak portaging device there are no separate loose pieces which must be attached by screws, ropes, bungies, or other mechanical means, then removed and stored on or within the kayak when not in use. The kayak portaging device is very safe and simple, comprised of only one moving part, which when deployed in its carry/portaging position, rests against two positive stops. When rotated into the carry/portaging position, two small powerful magnets in the yoke frame/backrest, and two powerful magnets located just above the positive stops, hold the portaging device in position while the kayak is lifted and placed on the carrier's shoulder. Once placed on the carrier's shoulders, the weight of the kayak against the positive stops hold the portaging device in position while in use. The yoke frame/backrest can be engaged from its stored position and rotated to its useable position in a matter of seconds and can be disengaged just as easily.

BRIEF DESCRIPTION OF THE DRAWINGS

The present invention may be understood from the description of the preferred embodiment which follows and from the accompanying drawings. The drawings are hereby expressly made a part of the specification.

DETAILED DESCRIPTION OF THE INVENTION

Figure 1:
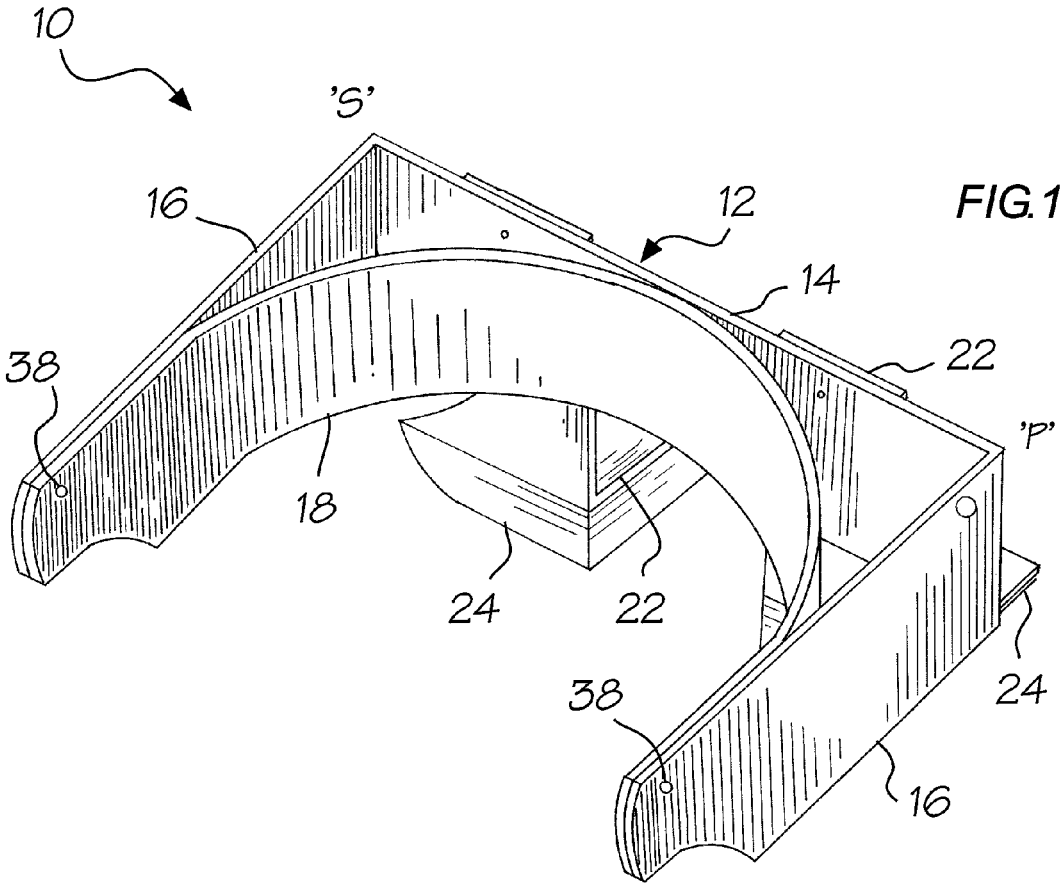
FIG. 1 is a front perspective view of the kayak portaging device as it would appear when in the storage/backrest position.

Reference is made herein to the attached drawings. Like reference numerals are used throughout the various drawings to depict like or similar elements of the claimed portaging device. For the purpose of presenting a brief and clear discussion of the portaging device, the preferred embodiment will be discussed primarily as depicted for use in a kayak. This is for representative purposes only and should not be construed as limiting the adaptation and use of this device in other types of suitable watercraft.

Figure 4:
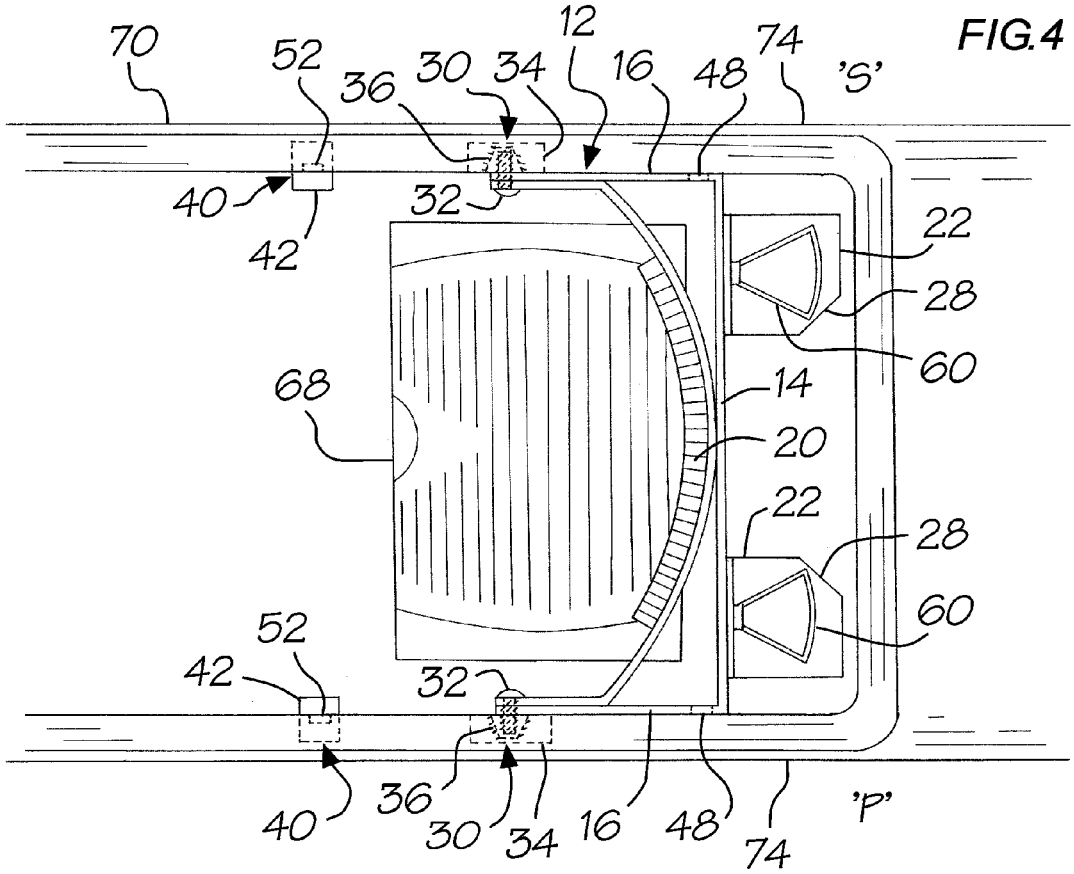
FIG. 4 is a closeup view of the device depicted in FIG. 3.

The preferred embodiment of the kayak portaging device 10 is a u-shaped device which generally includes a yoke frame/backrest assembly 12 as can be seen in FIG. 1, a pivot assembly 30 as can be seen in FIG. 4, a stop/lock assembly 40 as can be seen in FIG. 4, and a pair of bottle holders 60 as can be seen in FIG. 4.

Figure 2:
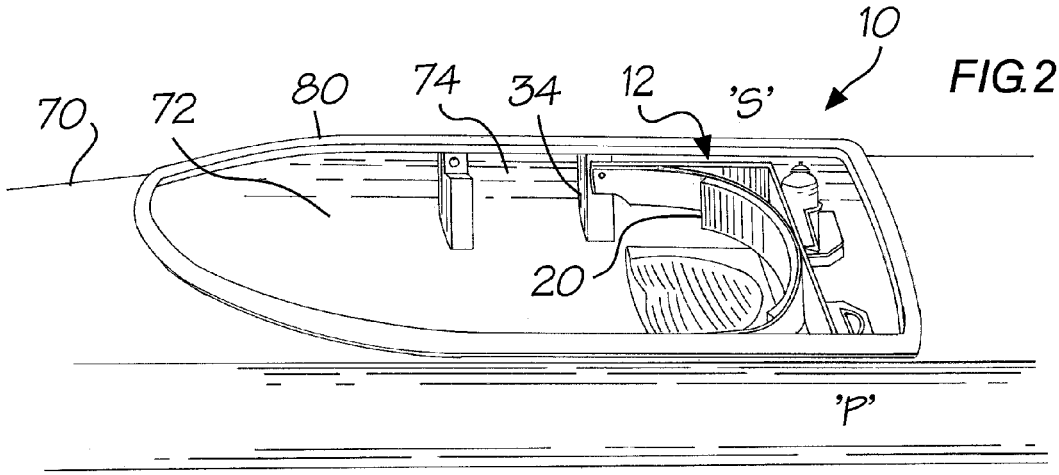
FIG. 2 is a side perspective view of the device depicted in FIG. 1, as it would appear installed in the cockpit of a kayak, with the inclusion of foam padding on the seat backrest.

Referring now to FIG. 1, the yoke frame/backrest assembly 12 is seen as it would appear when in the storage/backrest position, stowed behind the kayak seat with the backrest frame 18 positioned to provide back support to a kayaker while paddling. This is made clear by viewing FIG. 2, which shows the kayak portaging device 10 as it would appear installed in the cockpit 72 of a kayak 70 in the same configuration as shown in FIG. 1.

The yoke frame/backrest assembly 12 is generally an open ended box frame design, and includes a transverse yoke frame member 14 on the closed backside of the yoke frame/backrest assembly 12, having a starboard end 'S' and a port end 'P'; a pair of parallel pivot arms 16 generally extending perpendicularly forward from each end of the transverse yoke frame member 14 to the open end of the yoke frame/backrest assembly 12; a rigid curved backrest frame 18, inscribed, mounted and incorporated within the yoke frame/backrest assembly 12, facing the open end of the yoke frame/backrest assembly 12; and a pair of "L" brackets 22, which are mounted on the backside of the transverse yoke frame member 14, a shoulder's width apart, facing rearwards and extending downwards, with shoulder pads 24 attached to the bottom end of the "L" brackets 22, which act as shoulder rests when used for portaging, and to which the bottle holders 60 are mounted, as can be seen in FIGS. 4, 6, 8 and 9. The yoke frame/backrest assembly 12 may also include a backrest cushion 20 attached to the inside curve of the backrest frame 18, as can be seen in FIGS. 2, 4, 7 and 9.

Referring now to FIG. 4, the yoke frame/backrest assembly 12 generally extends transversely across the longitudinal axis of the kayak (as can also be seen in FIGS. 2 and 3) between the hull walls 74, one pivot arm 16 extending forward from the starboard 'S' end of the transverse yoke frame member 14 to a pivot assembly 30 secured to the starboard 'S' hull wall 74, and one pivot arm 16 extending forward from the port 'P' end of the transverse yoke frame member 14 to a pivot assembly 30 secured to the port 'P' hull wall 74. Each pivot assembly 30 generally includes a pivot pin 32, a pivot hole 38 (which can be seen in FIG. 1) in the pivot end of a pivot arm 16 through which the pivot pin 32 passes, hull blocking 34 attached to a hull wall 74 on either the starboard or the port side of the kayak 70 (which can also be seen in FIG. 2) and a threaded insert 36 embedded into the hull blocking 34 into which the pivot pin 32 is inserted and attached, pivotally securing the pivot arm 16 to the hull blocking 34 and thereby to the hull wall 74 of the kayak 70, and creating a pivot point about which the yoke frame/backrest assembly 12 rotates (individual pivot assembly components can also be clearly seen in FIG. 9).

Figure 5A:
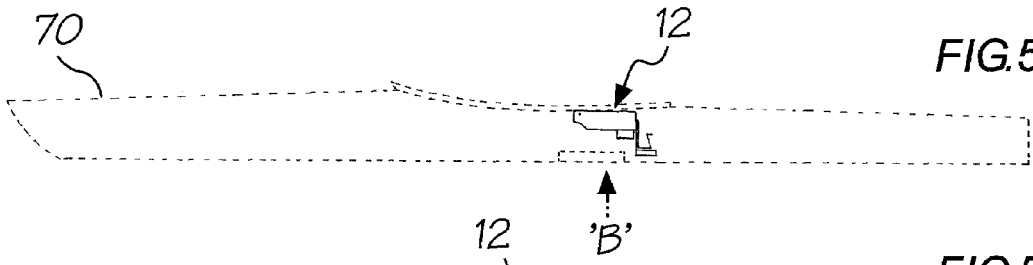
FIG. 5A is a left side view of the device depicted in FIG. 3, showing its positioning within an imaginary kayak.
Figure 5B:
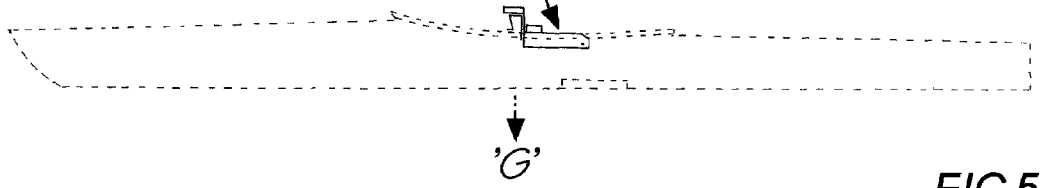
FIG. 5B is a left side view of the device depicted in FIG. 5A, showing its positioning within an imaginary kayak when rotated into the carry/portaging position.
Figure 5C:
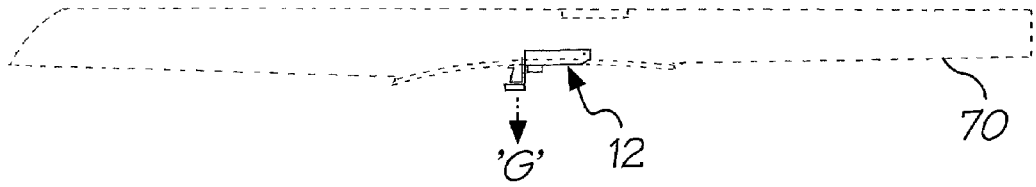
FIG. 5C is a left side view of the device depicted in FIG. 5B, after the imaginary kayak has been inverted for carrying/portaging.
Figure 6:
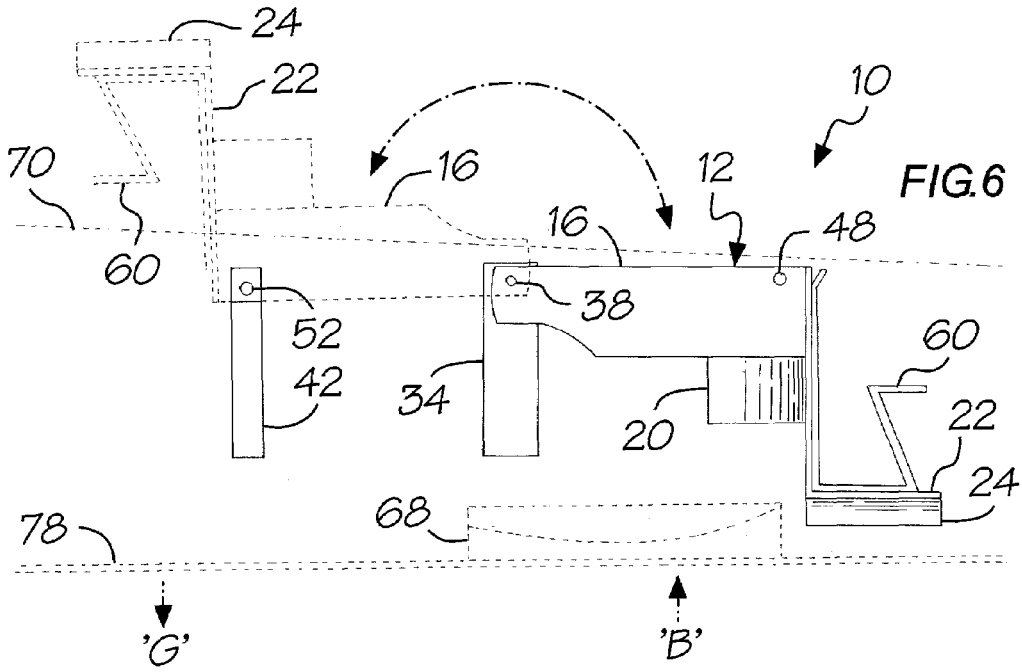
FIG. 6 is a left side closeup view of the device depicted in FIG. 5A, while also indicating the rotation to its alternate carry/portaging position as depicted in FIG. 5B, with starboard hull blocking and stop block also shown.

Referring now to FIG. 6, the pivot assemblies 30 (which can be seen in FIG. 4) integrally and pivotally attach the yoke frame/backrest assembly 12 to the kayak 70 and allow the yoke frame/backrest assembly 12 to rotate arcuately from a rearward backrest position, located behind the kayak's seat 68 and center of buoyancy 'B' (which position is also depicted in FIG. 5A), where the backrest is oriented for use by a kayaker sitting in the kayak seat 68 while paddling, forward to an inverted position located over the kayak's center of gravity 'G' (which position is also depicted in FIG. 5B), where the "L" brackets 22 with their shoulder padded ends 24 now face and extend upwards from the yoke frame/backrest assembly 12, acting as shoulder rests which are ready for use in carrying/portaging the kayak 70 when the kayak is lifted and inverted so that the shoulder pads 24 can be placed on an individuals shoulders with the inverted kayak above the carrier's head (which position is depicted in FIG. 5C).

Figure 7:
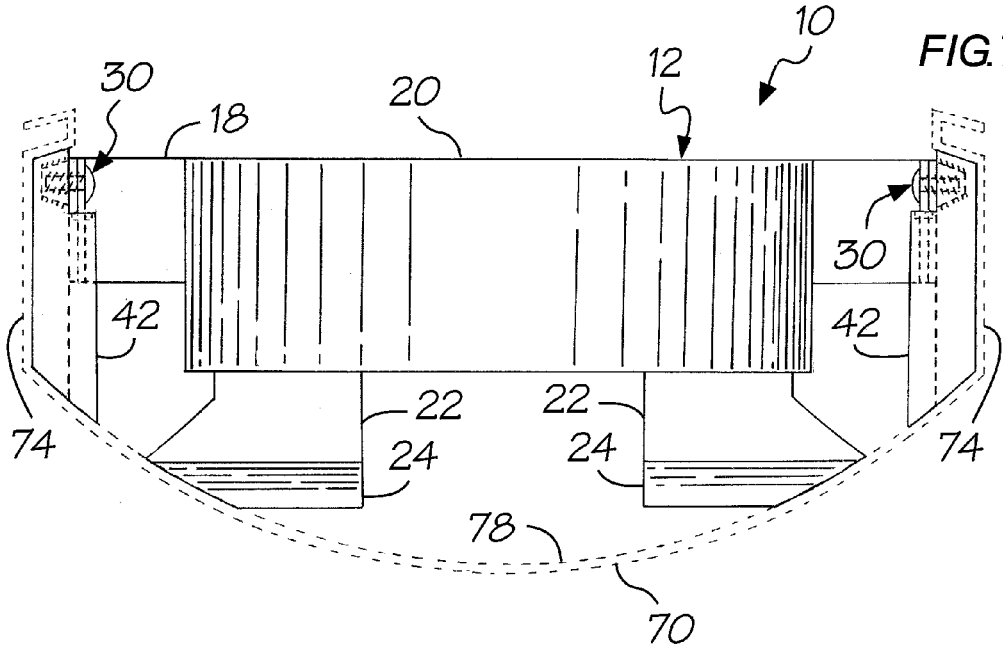
FIG. 7 is a front elevation view of the device depicted in FIG. 6, but does not indicate it's alternate portaging position, with hull blocking and stop blocks also being shown.

The location on the inner starboard and port hull walls 74 of the kayak 70 at which the pivot assemblies 30 must be installed (as can be seen in FIGS. 4 and 7) to create a proper pivot point for the yoke frame/backrest assembly 12 can be easily determined with an understanding of the relationship between a kayak's center of buoyancy 'B' and it's center of gravity 'G'. In a canoe these two points are commonly found in approximately the same location. In a kayak 70 however, the center of buoyancy 'B', which is the point of equal weight distribution to buoyant surfaces, and which is the optimal seating position for a kayaker when paddling (to optimize hull paddling speed and performance), is generally one or two feet aft of the kayak's center of gravity 'G', which is the point of equal weight distribution for carrying a kayak 70, or it's center of balance.

The center of buoyancy 'B' determines the location of the kayak seat 68 and yoke frame/backrest assembly 12 (when in the storage/backrest position) in relation to supporting the users upper body while paddling. The center of gravity 'G' determines the location of the shoulder pads 24 and the "L" brackets 22 on which they are mounted (when the yoke/frame backrest assembly 12 is in the inverted/portaging position), which must be vertically centered on this point to achieve a kayak 70 which balances equally when carried. Once the position of the yoke frame/backrest assembly 12 (when positioned behind the center of buoyancy 'B') and the position of the shoulder pads 24 and the "L" brackets 22 (when vertically aligned with the center of gravity 'G') have been determined, the yoke frame/backrest assembly 12 pivot point is located approximately ½ the overall distance between these two positions. This then also determines the length of the pivot arms 16 and the overall length longitudinally of the yoke frame/backrest assembly 12.

The kayak portaging device 10 can accommodate varying distances of separation between the center of buoyancy and the center of gravity as found in different kayak designs, by lengthening or shortening the pivot arms 16 which attach the yoke frame/backrest assembly 12 to the kayak 70.

The pivot assembly 30 also needs to be placed as high as possible on the kayak hull to maximize the headroom when the yoke frame/backrest assembly 12 is rotated forward into the carrying/portaging position, as can be seen in FIGS. 5B, 5C and 6. This pivot assembly 30 also needs to be located near the top edge of the pivot arms 16 to maintain the needed distance between the shoulder pads 24 and the inside hull bottom 78 of the kayak 70 for carrying headroom.

Figure 9:
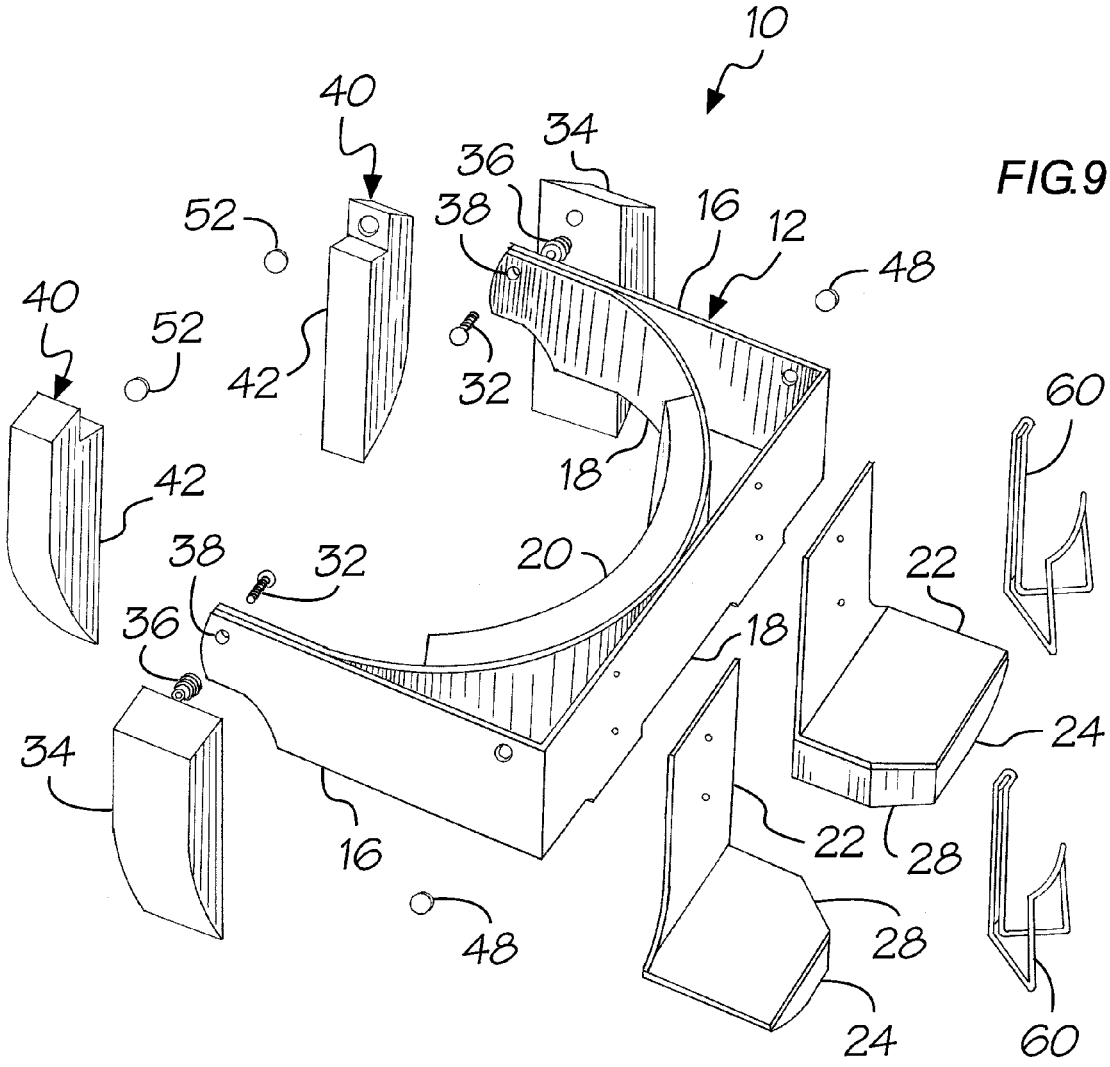
FIG. 9 is a side perspective exploded view of the device depicted in FIG. 7, without any depiction of the imaginary kayak.

The backrest frame 18 (as can be seen in FIG. 9), as an integral part of the yoke frame/backrest assembly 12, is positioned to provide support for a paddler's upper body when the kayaker is seated in the legs straight forward position typically used in a kayak. A kayaker will sit on either the bottom interior surface of the kayak 70 hull bottom 78 or on a thin cushion/pad used for a seat 68. Since the height/distance the paddler sits above the hull bottom 78 of the kayak 70 determines to a great degree the stability of the kayak 70, it is important to keep the paddler's center of gravity as low as possible by the incorporation of the backrest portion of the kayak 70 into the yoke frame/backrest assembly 12. The seat 68 can remain very thin thereby maintaining the greatest stability possible. An increase in ½ inch height can have a major influence on kayak stability. In a canoe the paddler is seated on an elevated seat, without a backrest for support. Since a canoe is much wider than a kayak, stability is less of an issue. Paddling positions can vary from kneeling to sitting without as much concern for the paddler's distance above the center of gravity.

Referring now to FIG. 9, the stop/lock assembly 40 is generally a pair of stop blocks 42 attached to the kayak inside hull wall (as can be seen in FIGS. 4 and 7), one attached to the starboard hull wall and one attached to the port hull wall, approximate to the kayak's center of gravity "G" (as can be seen in FIG. 6), against which the leading edge of the yoke pivot arms 16 will stop and be supported at a desired use height, when the yoke frame/backrest assembly 12 is rotated into the forward position for portaging. The stop/lock assembly 40 is also adapted to selectively prevent rotation of the yoke frame/backrest assembly 12 by means of two complimentary pairs of magnets, one magnet 48 being attached to each pivot arm 16, and one complimentary magnet 52 being attached to each stop block 42, such that when the yoke frame/backrest assembly 12 is rotated into the forward position for portaging, the magnets 48 will be adjacent to the complimentary magnets 52 such that they will become magnetically attracted to each other with sufficient magnetic force to hold the yoke frame/backrest assembly 12 in the forward position for carrying the kayak.

Figure 10:
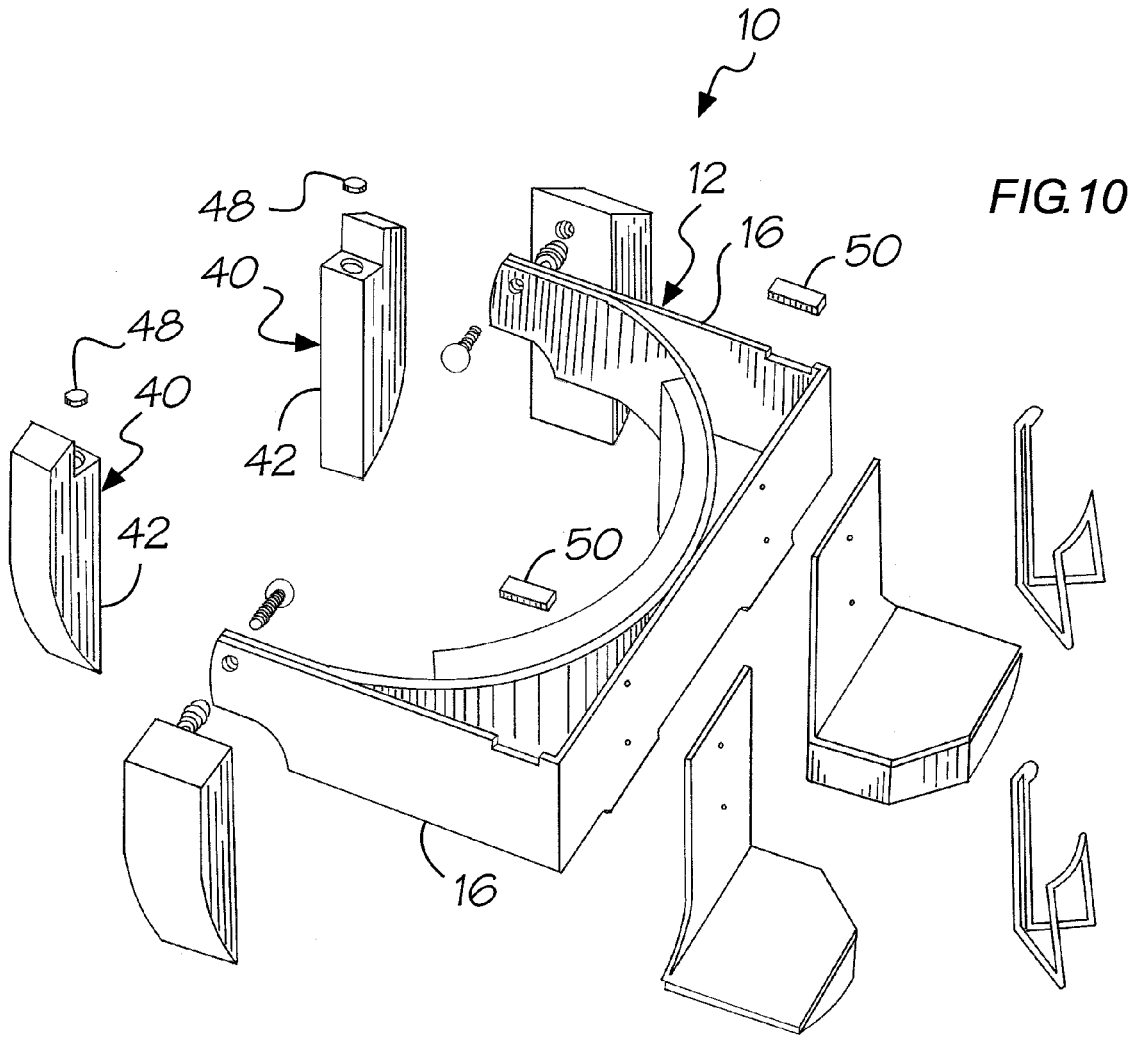
FIG. 10 is a side perspective exploded view of an alternate embodiment of the kayak portaging device.

Referring not to FIG. 10, the stop/lock assembly 40 may also make use of an alternate configuration (which can be seen in FIG. 10) which is adapted to selectively prevent rotation of the yoke frame/backrest assembly 12 by means of a pair of magnets 48 and a complimentary pair of magnetically attractive contact plates 50, one magnet 48 being attached to the top of each stop block 42, and one complimentary contact plate 50 being attached to the leading edge of each pivot arm 16, such that when the yoke frame/backrest assembly 12 is rotated into the forward position for portaging, the contact plates 50 will contact and become magnetically connected to the magnets 48 with sufficient magnetic force to hold the yoke frame/backrest assembly 12 in the forward position for carrying the kayak.

The use of a magnetic latching system in the stop/lock assembly 40 allows the yoke frame/backrest assembly 12 to be rotated from its stored backrest position and engaged in its forward carrying position in a matter of seconds. No levers, hooks, ropes, bungies, catches, clamps or mechanical means are required to hold the device in its forward carrying position. As easily as it is to engage this device to its carrying position, the yoke frame/backrest assembly 12 can be disengaged and rotated to its stored backrest position in a matter of seconds, again with no screws, hooks, clamps, ropes, bungies, or other mechanical means needing to be removed. Being a non-removable part of the kayak, the device cannot be lost or misplaced when stored.

Figure 8:
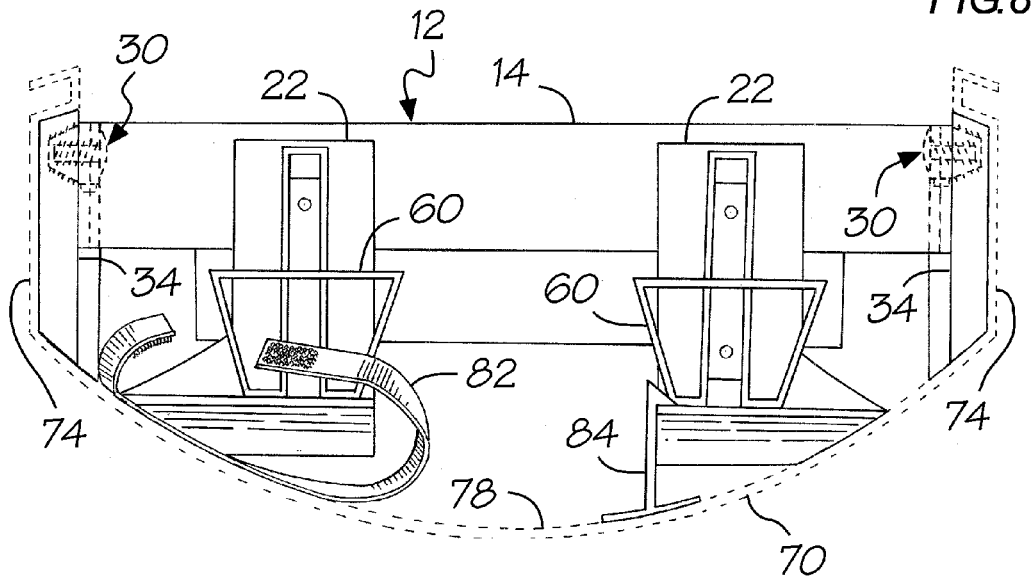
FIG. 8 is a rear elevation view of the device depicted in FIG. 7, with the inclusion of hold-downs for the device in this position.

Referring now to FIG. 6, it can be seen that when the yoke frame/backrest assembly 12 is in the forward/portaging position, that the "L" brackets 22 extend vertically from the yoke frame/backrest assembly 12 to allow sufficient headroom between the top of the carriers head and the inside hull bottom 78 of the kayak 70, when the kayak is placed on the carriers shoulders. The foam shoulder pads 24 are contoured to the shape of the kayak hull bottom 78 as can be seen in FIGS. 7 and 8 (this contour can also be seen in FIG. 1), which allows for the backrest frame 18 and attached backrest pad 20 to assume a lower natural lumbar placement for user comfort and support, and allows for a higher placement of the pivot assemblies 30 on the pivot arms. When the yoke frame/backrest assembly 12 is rotated forward into the carrying/portaging position, this also increases the distance from the leading edge of the pivot arms 16 (which contact the stop blocks 42), to the carrying surface of the shoulder pads 24. Maintaining this distance is important for head clearance while carrying/portaging the kayak 70. In FIGS. 4 and 9 it can be seen that the "L" brackets 22, and the shoulder pads 24 attached to them, have an angled corner segment 28 on the inside corner section of the bottom portion of the bracket which rests on the carriers shoulders. This facilitates the placement and removal of the kayak from the carriers shoulders by providing a larger opening for the neck area of the user.

Referring now to FIG. 9, the kayak portaging device 10 further provides for the secure storage of water bottles to be readily accessible while kayaking, having two water bottle holders 60 attached to the topside of the yoke frame/backrest assembly 12, one above each "L" bracket 22 shoulder rest, positioned to allow for the use of the kayak portaging device 10 for portaging without interference from the bottle holders 60. When the yoke frame/backrest assembly 12 is rotated to the rearward position behind the kayak seat, the water bottle holders 60 are then accessible behind a seated kayaker while paddling (which can also be seen in FIGS. 2, 4 and 6).

Having easily accessed liquids in the cockpit area and available to the kayaker is of great importance in maintaining hydration while paddling. By placing the water bottle holders directly over the shoulder pads 24, when the yoke frame/backrest assembly 12 is rotated forward into the carrying/portaging position (as can be seen in FIG. 6), the overall balance of the kayak in relation to the kayak portaging device is not affected. There is no effect on the balance of the kayak in the carrying/portaging position whether the bottles are full or empty because they are in vertical alignment with the kayak's center of gravity at the center of balance. Any other location, would cause a horizontal shift in the center of balance when liquid levels or bottle sizes are changed. When paddling the kayak (the yoke frame/backrest assembly 12 being in the rearward backrest position), the bottles would be oriented in the upright position. When carrying the kayak (the yoke frame/backrest assembly 12 being in the forward carrying position), the bottles also remain in the upright oriented position. The only time the bottles would be oriented upside down, is the short period of time between engaging the yoke frame/backrest assembly 12 into its carrying/portaging position, and lifting and placing the kayak on the carriers shoulders.

Figure 3:
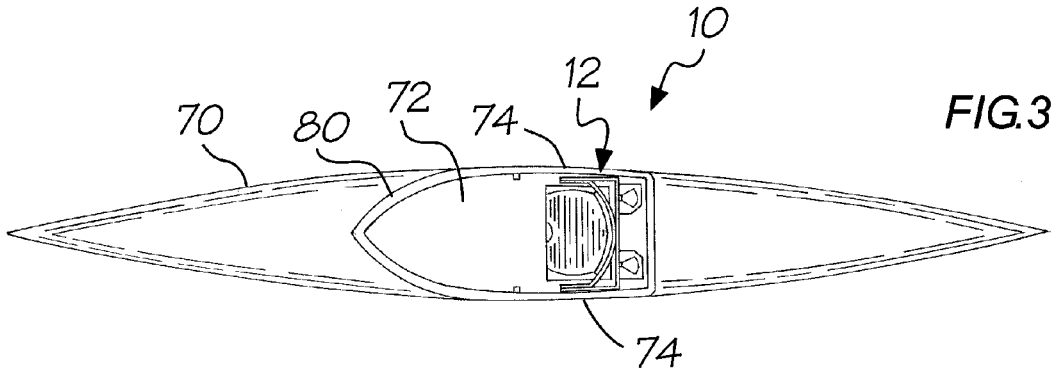
FIG. 3 is a top planar view of the device depicted in FIG. 2, with a view of the entire kayak.

To use the kayak portaging device 10 requires that the cockpit 72 of a kayak 70 be enlarged from that found in a typical kayak. To accomplish the rotating of the yoke frame/backrest assembly 12 from the rearward backrest position to the forward portaging position, the kayak cockpit 72 must have sufficient space behind the yoke frame/backrest assembly 12 to allow the "L" brackets 22 and shoulder pads 24 mounted on the back side of the transverse yoke frame member 14 to clear the cockpit rim 80 (as can be seen in FIG. 3). More space in the front of the cockpit 72 is also required to allow for a user's head to clear the edges of the cockpit 72 when placing the kayak on the user's shoulders in the carrying position for portaging. A larger cockpit 72 also allows for improved visual sight lines when carrying the kayak 70, thereby improving safety.

What is claimed is:

1. A kayak portaging device, for use in a single seat kayak having a centrally located cockpit opening about the kayak's center of gravity, and a seat located within the cockpit opening and centrally located over the kayak's center of buoyancy and approximate to the kayak's center of gravity, the kayak portaging device comprising:

a portaging means, and a rotation means attached thereto;

said portaging means adapted to allow a kayak having a seat centrally located over the kayak's center of buoyancy and approximate to the kayak's center of gravity, to be carried in an inverted position bow forward on the shoulders of a user; and said rotation means integrally attaching said portaging means to said kayak and allowing said portaging means to rotate arcuately from a first position to a second inverted position;

wherein said first position is located behind said kayak's centrally located seat and center of buoyancy, for storage while paddling; and wherein said second position is located over said kayak's center of gravity for carrying said kayak.

2. The kayak portaging device according to claim 1, further comprising a back support means incorporated within said portaging means, whereby support is provided for a kayaker's back while sitting upon the kayak seat, and while said portaging means is in said first position behind said kayak seat.

3. The kayak portaging device according to claim 2, further comprising a stop means whereby said portaging means is stopped and supported at a desired use height when rotated to said second position.

4. The kayak portaging device according to claim 3, further comprising a locking means adapted to selectively prevent rotation of said portaging means.

5. The kayak portaging device according to claim 1, wherein said portaging means is comprised of a yoke frame member with a starboard end and a port end, and a pair of shoulder rests centrally located thereon, said frame member extending transversely across the longitudinal axis of said kayak between the starboard and port hull walls; and wherein said rotation means is comprised of a pair of parallel pivot arms extending perpendicularly from each end of said yoke frame member, one pivot arm extending from said starboard end of said frame member to a pivot means secured to the starboard hull wall, one pivot arm extending from said port end of said frame member to a pivot means secured to the port hull wall; and wherein said yoke rotates arcuately around said pivot means on said pivot arms from said first position to said second position.

6. The kayak portaging device according to claim 5, further comprising a back support means incorporated within said portaging means, whereby support is provided for a kayaker's back while sitting upon the kayak seat, and while said portaging means is in said first position behind said kayak seat.

7. The kayak portaging device according to claim 6, further comprising a stop means whereby said yoke is stopped and supported at a desired use height when rotated to said second position.

8. The kayak portaging device according to claim 7, wherein said stop means is comprised of a pair of stop blocks, one attached to the kayak starboard hull wall and one attached to the port hull wall, approximate to the kayak's center of gravity, against which said yoke pivot arms will stop and rest when said portaging device is rotated into said second position.

9. The kayak portaging device according to claim 8, further comprising a locking means adapted to selectively prevent rotation of said yoke.

10. The kayak portaging device according to claim 9, wherein said locking means is comprised of at least one complimentary pair of magnetically linking components, one component attached to said portaging device and one complimentary component attached to said kayak, such that when said device is rotated into said second position, said complimentary components will become magnetically linked to each other with sufficient magnetic force to hold said device in said second position against said stop blocks for carrying said kayak.

11. The kayak portaging device according to claim 9, wherein said locking means is comprised of two complimentary pairs of magnetically linking components, one component attached to each said pivot arm and one complimentary component attached to each said stop block, such that when said yoke frame is rotated into said second position, said complimentary components will become magnetically linked to each other with sufficient magnetic force to hold said device in said second position against said stop blocks for carrying said kayak.

12. A kayak portaging device, for use in a single seat kayak having a centrally located cockpit opening about the kayak's center of gravity, and a seat located within the cockpit opening and centrally located over the kayak's center of buoyancy and approximate to the kayak's center of gravity, the kayak portaging device comprising:

a portaging means, a rotation means attached thereto, and a back support means incorporated within said portaging means;

said portaging means adapted to allow a kayak having a seat centrally located over the kayak's center of buoyancy and approximate to the kayak's center of gravity, to be carried in an inverted position bow forward on the shoulders of a user;

said portaging means comprising a yoke frame member with a starboard end and a port end, and a pair of shoulder rests centrally located thereon, said frame member extending transversely across the longitudinal axis of said kayak between the starboard and port hull walls;

said rotation means comprising a pair of parallel pivot arms extending perpendicularly from each end of said yoke frame member, one pivot arm extending from said starboard end of said frame member to a pivot means secured to the starboard hull wall, one pivot arm extending from said port end of said frame member to a pivot means secured to the port hull wall; and said back support means comprising a curved backrest portion incorporated within said yoke frame between said pivot arms and facing the rotational axis of said device;

wherein said pivot arms integrally attach said yoke frame member to said kayak and allow said yoke frame member to rotate arcuately from a first position to a second inverted position;

wherein said first position is located behind the kayak's centrally located seat and center of buoyancy, where said backrest is oriented for use by a kayaker sitting in said kayak seat; and wherein said second position is located over said kayak's center of gravity with said shoulder rests facing upwards from said yoke frame member and ready for use to carry said kayak.

13. The kayak portaging device according to claim 12, wherein said pivot means is comprised of a pair of pivot pin and bushing assemblies.

14. The kayak portaging device according to claim 12, wherein said back rest is cushioned.

15. The kayak portaging device according to claim 12, wherein said yoke frame member and parallel pivot arms together define a u-shaped frame;

wherein said back rest is further comprised of a rigid contoured backrest frame inscribed, mounted and incorporated within said u-shaped frame; and wherein said back rest is cushioned.

16. The kayak portaging device according to claim 12, further comprising a storage means for the secure storage of items to be readily accessible while kayaking;

said yoke frame having a topside and an underside;

said storage means being attached to the topside of said yoke frame above said shoulder rests, and allowing for the use of said yoke frame without interference; and whereby when said yoke frame is rotated to said first position, said storage means is then accessible behind the kayak seat.

17. The kayak portaging device according to claim 16, wherein said storage means is comprised of at least one bottle holder;

said bottle holder being attached to the topside of said yoke frame, offset from center and allowing for the use of said yoke frame for portaging without interference; and whereby when said yoke frame is rotated to said first position, said bottle holder is then accessible behind the kayak seat.

18. The kayak portaging device according to claim 12, further comprising a stop means whereby said yoke is stopped and supported at a desired use height when rotated to said second position;

wherein said stop means is comprised of a pair of stop blocks, one attached to the kayak starboard hull wall and one attached to the port hull wall, approximate to the kayak's center of gravity, against which said yoke pivot arms will stop and rest when said portaging device is rotated into said second position.

19. The kayak portaging device according to claim 18, further comprising a locking means adapted to selectively prevent rotation of said yoke;

wherein said locking means is comprised of at least one complimentary pair of magnetically linking components, one component attached to said portaging device and one complimentary component attached to said kayak, such that when said device is rotated into said second position, said complimentary components will become magnetically linked to each other with sufficient magnetic force to hold said device in said second position against said stop blocks for carrying said kayak.

20. The kayak portaging device according to claim 19, wherein said locking means is comprised of two complimentary pairs of magnetically linking components, one component attached to each said pivot arm and one complimentary component attached to each said stop block, such that when said yoke frame is rotated into said second position, said complimentary components will become magnetically linked to each other with sufficient magnetic force to hold said device in said second position against said stop blocks for carrying said kayak.

* * * * *